US006035051A

United States Patent [19]

Sato

[11] Patent Number: 6,035,051

[45] Date of Patent: Mar. 7, 2000

[54] SOUND APPARATUS

[75] Inventor: Masaru Sato, Tokyo, Japan

[73] Assignee: Sony Corporation, Tokyo, Japan

[21] Appl. No.: 09/071,936

[22] Filed: May 4, 1998

[30] Foreign Application Priority Data

May 12, 1997 [JP] Japan ..... P09-120833

[51] Int. Cl.[7] ..... H04R 25/00

[52] U.S. Cl. ..... 381/340; 381/341; 381/342; 381/306; 381/388; 381/89; 181/152

[58] Field of Search ..... 381/300–308, 381/89, 332–336, 150, 152, 337–343, FOR 143, FOR 142, 71.7; 181/152, 155–6, 159, 177, 175, 179, 198–9, 141

[56] References Cited

U.S. PATENT DOCUMENTS

| | | | |
|---|---|---|---|
| 1,568,589 | 1/1926 | Eddington | 381/342 |
| 2,790,164 | 4/1957 | Oberg | 381/342 |
| 4,845,759 | 7/1989 | Danley | 381/342 |
| 4,926,487 | 5/1990 | Yoshida et al. | 381/306 |
| 4,930,596 | 6/1990 | Saiki et al. | 381/338 |
| 5,097,923 | 3/1992 | Ziegler et al. | 381/71.1 |
| 5,140,641 | 8/1992 | Danley et al. | 381/339 |
| 5,432,857 | 7/1995 | Geddes | 381/71.1 |
| 5,452,025 | 9/1995 | Koizumi | 381/306 |
| 5,524,062 | 6/1996 | Oh | 381/338 |
| 5,604,337 | 2/1997 | Sugimoto et al. | 381/339 |
| 5,606,297 | 2/1997 | Phillips | 381/337 |
| 5,675,131 | 10/1997 | Saito et al. | 181/152 |
| 5,710,394 | 1/1998 | Saito et al. | 181/152 |
| 5,815,589 | 9/1998 | Wainwright et al. | 381/338 |
| 5,825,900 | 10/1998 | Jeon | 381/339 |

FOREIGN PATENT DOCUMENTS

| | | |
|---|---|---|
| 3-204298 | 9/1991 | Japan . |
| 4-23697 | 1/1992 | Japan . |

*Primary Examiner*—Forester W. Isen
*Assistant Examiner*—Xu Mei
*Attorney, Agent, or Firm*—Jay H. Maioli

[57] ABSTRACT

A sound apparatus capable of obtaining a clear sound (audio image) irrespective of a position of a speaker portion to be provided in the sound apparatus. The sound apparatus includes a speaker portion and a plurality of sound guides each of which has one end portion connected to the speaker portion and has the other end portion opened; wherein lengths of the plurality of sound guides are nearly equal to each other and the other end portions of the sound guides are arranged such that sounds generated from the speaker portion are guided through the sound guides and collide with each other.

4 Claims, 11 Drawing Sheets

SOUND APPARATUS

BACKGROUND OF THE INVENTION

The present invention relates to a sound apparatus provided in electric equipment such as a television set or audio set.

A television set, which is one example of electric equipment, includes a display unit for displaying images and a sound apparatus for transmitting voices. The display unit is represented by a cathode-ray tube (CRT) and the sound apparatus generally has a plurality of speakers.

In a television set of this type, it is difficult to ensure a space for mounting a sound apparatus at a position on the front surface of a cabinet because of a requirement in design, and consequently, the sound apparatus may often be provided on the rear side of the cabinet.

FIGS. 1 to 5 show examples of related art television sets. A cabinet 300 of the related art television set shown in FIG. 1 contains a cathode-ray tube 301 and two speakers 302 and 303. The speakers 302 and 303 are positioned on the rear side of the cathode-ray tube 301, and more specifically, near an electron gun of the cathode-ray tube 301.

A cabinet 400 of the related art television set shown in FIG. 2 has a cathode-ray tube 401 and two speakers 402 and 403. The speakers 402 and 403 are positioned on the rear side of the cathode-ray tube 401 and are connected to horns 404 and 405, respectively.

A cabinet 500 of the related art television set shown in FIG. 3 contains a cathode-ray tube 501 and two speakers 502 and 503. The speakers 502 and 503 are disposed in such a manner as to be directed obliquely forward.

A cabinet 600 of the related art television set shown in FIG. 4 contains a cathode-ray tube 601 and four speakers 602 to 605. The speakers 602 and 603 are positioned on the rear side of the cathode-ray tube 601, and the remaining speakers 604 and 605 are disposed on the front side of the cabinet 600 on the right and left sides of the cathode-ray tube 601.

A cabinet 700 of the related art television set shown in FIG. 5 contains a cathode-ray tube 701 and two speakers 702 and 703 directed obliquely forward. The cabinet 700 has net-like portions 704 and 705 disposed near the cathode-ray tube 701.

The above-described cabinets of the related art television sets, however, have the following problems:

In the television set shown in FIG. 1, which has the simplest structure, since sounds generated from the two speakers 302 and 303 are transmitted from the rear side of the cabinet 300 to a listener positioned on the front surface side of the cathode-ray tube 301, the listener feels that the sounds are confined on the front surface side.

In the related art television set shown in FIG. 2, the speakers 402 and 403 are respectively connected to the horns 404 and 405 and opening portions of the horns 404 and 405 are led up to the right and left positions of the cathode-ray tube 401; however, the combination of a simple speaker with a simple horn gives confined feeling of sound to the listener, with a result that the listener cannot clearly hear the sounds.

In the related art television set shown in FIG. 3, sounds generated from the speakers 502 and 503 are reflected once from the inner wall of the cabinet 500 and are then fed forward from holes 505 and 504 formed on the right and left sides of the cathode-ray tube 501. In this case, however, if the opening ratio of each of the holes 504 and 505 is low, sounds may be confined and further chattering of the cabinet 500 may be generated. A high frequency sound is relatively easily audible but a low frequency sound may be confined.

In the related art television set shown in FIG. 4, the tweeters 604 and 605 for high frequency sounds are positioned on the right and left sides of the cathode-ray tube 601. This is intended to make clear high frequency sounds. However, the woofers 602 and 603 for low frequency sounds, provided behind the tweeters 604 and 605, may be confined like the example shown in FIG. 1.

In particular, sounds in narration and conversation may be confined like the example shown in FIG. 1.

In the related art television set shown in FIG. 5, sounds generated from the speakers 702 and 703 positioned on the rear side are transmitted onto the front surface side through the net-like portions 704 and 705; however, if the opening ratio of each of the net-like portions 704 and 705 is low, sounds may be also confined.

SUMMARY OF THE INVENTION

An object of the present invention is to provide a sound apparatus capable of obtaining a clear sound (audio image) irrespective of a position of a speaker portion provided in the sound apparatus.

To achieve the above object, according to the present invention, there is provided a sound apparatus including a speaker portion; and a plurality of sound guides each of which has one end portion connected to the speaker portion and has the other end portion opened; wherein the lengths of the plurality of sound guides are nearly equal to each other; and the other end portions of the sound guides are arranged such that sounds generated from the speaker portion are guided through the sound guides and collide with each other.

In accordance with the sound apparatus of the present invention, the lengths of the sound guides are nearly equal to each other and the other end portions of the sound guides are arranged such that sounds generated from the speaker portion are guided through the sound guides and collide with each other, and accordingly, sounds having the same phase are synthesized by collision, to thus obtain an audio image which is audible to a listener as if the audio image was generated from a speaker portion located on the side of the other end portions of the sound guides. This makes it possible to generate a clear sound (audio image) irrespective of a position of the speaker portion provided in the sound apparatus.

DETAILED DESCRIPTION OF THE PREFERRED EMBODIMENTS

Hereinafter, preferred embodiments of the present invention will be described in detail with reference to the accompanying drawings.

Figure 1:
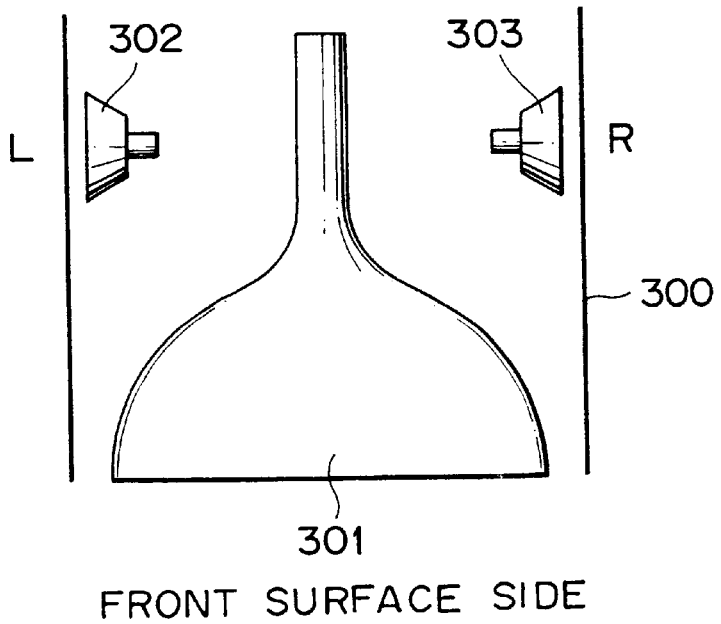
FIG. 1 (PRIOR ART)
FIG. 1 is a view showing a television set to which a related art sound apparatus mounting method is applied.
Figure 2:
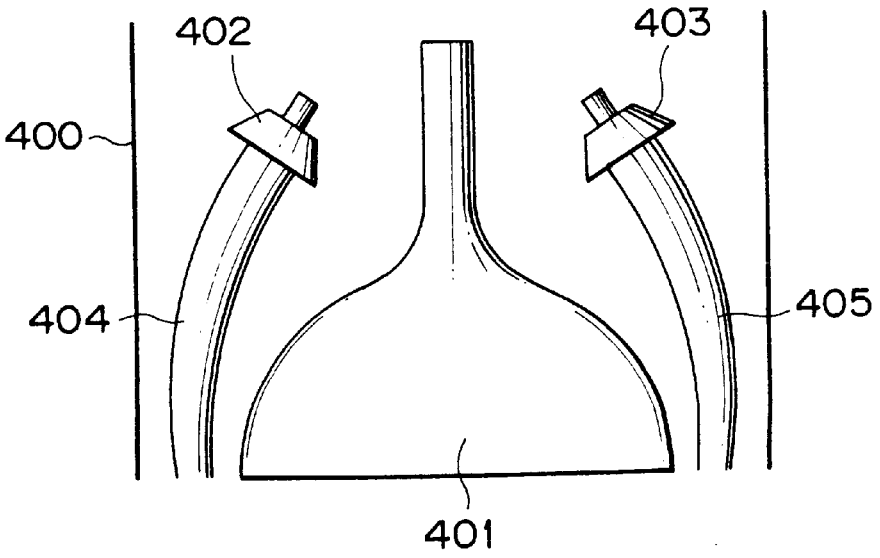
FIG. 2 (PRIOR ART)
FIG. 2 is a view showing a television set to which another related art sound apparatus mounting method is applied.
Figure 3:
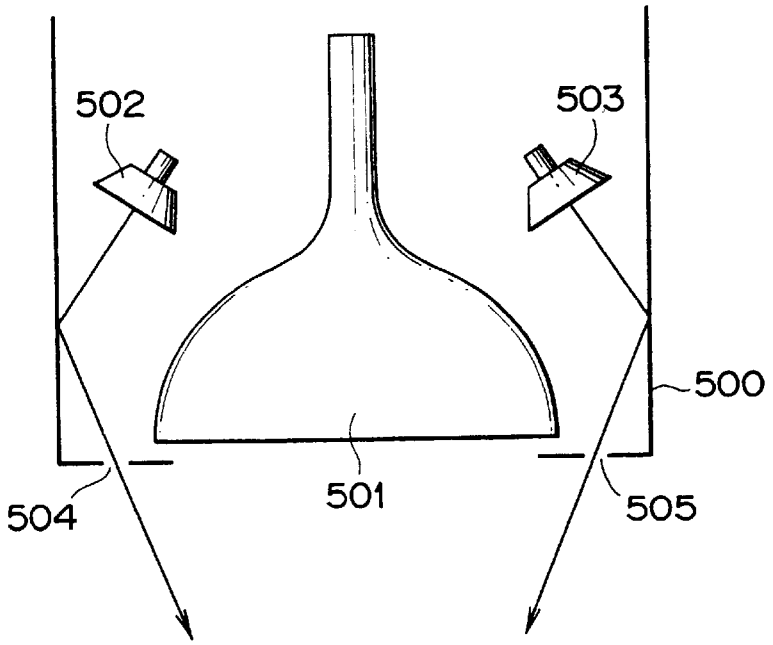
FIG. 3 (PRIOR ART)
FIG. 3 is a view showing a television set to which a further related art sound apparatus mounting method is applied.
Figure 4:
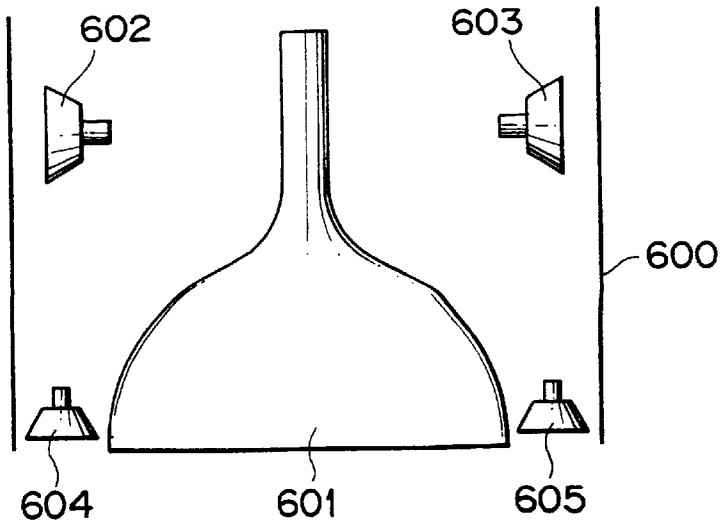
FIG. 4 (PRIOR ART)
FIG. 4 is a view showing a television set to which a further related art sound apparatus mounting method is applied.
Figure 5:
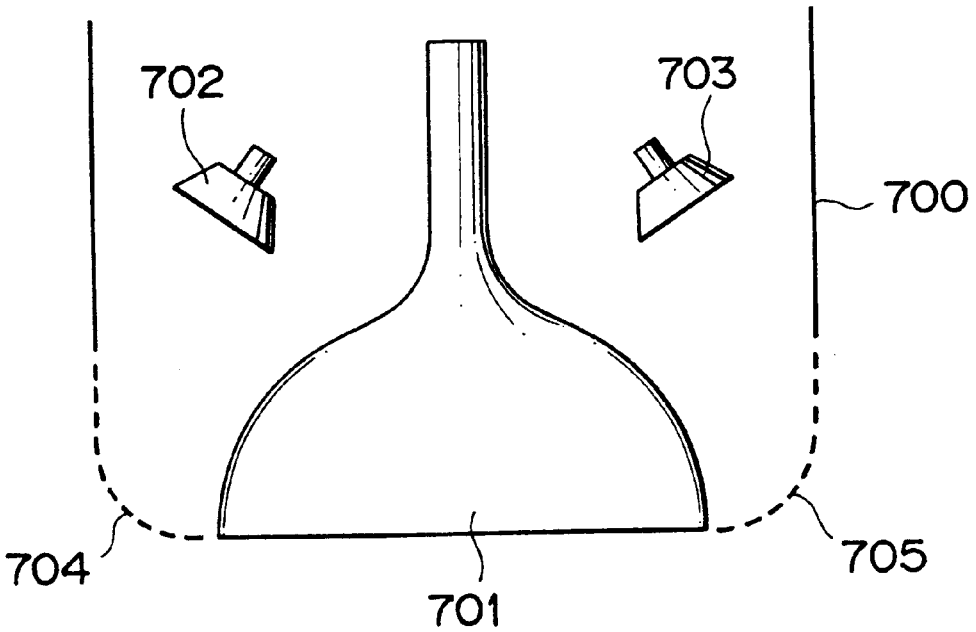
FIG. 5 (PRIOR ART)
FIG. 5 is a view showing a television set to which a further related art sound apparatus mounting method is applied.
Figures 6A, 6B, 6C:
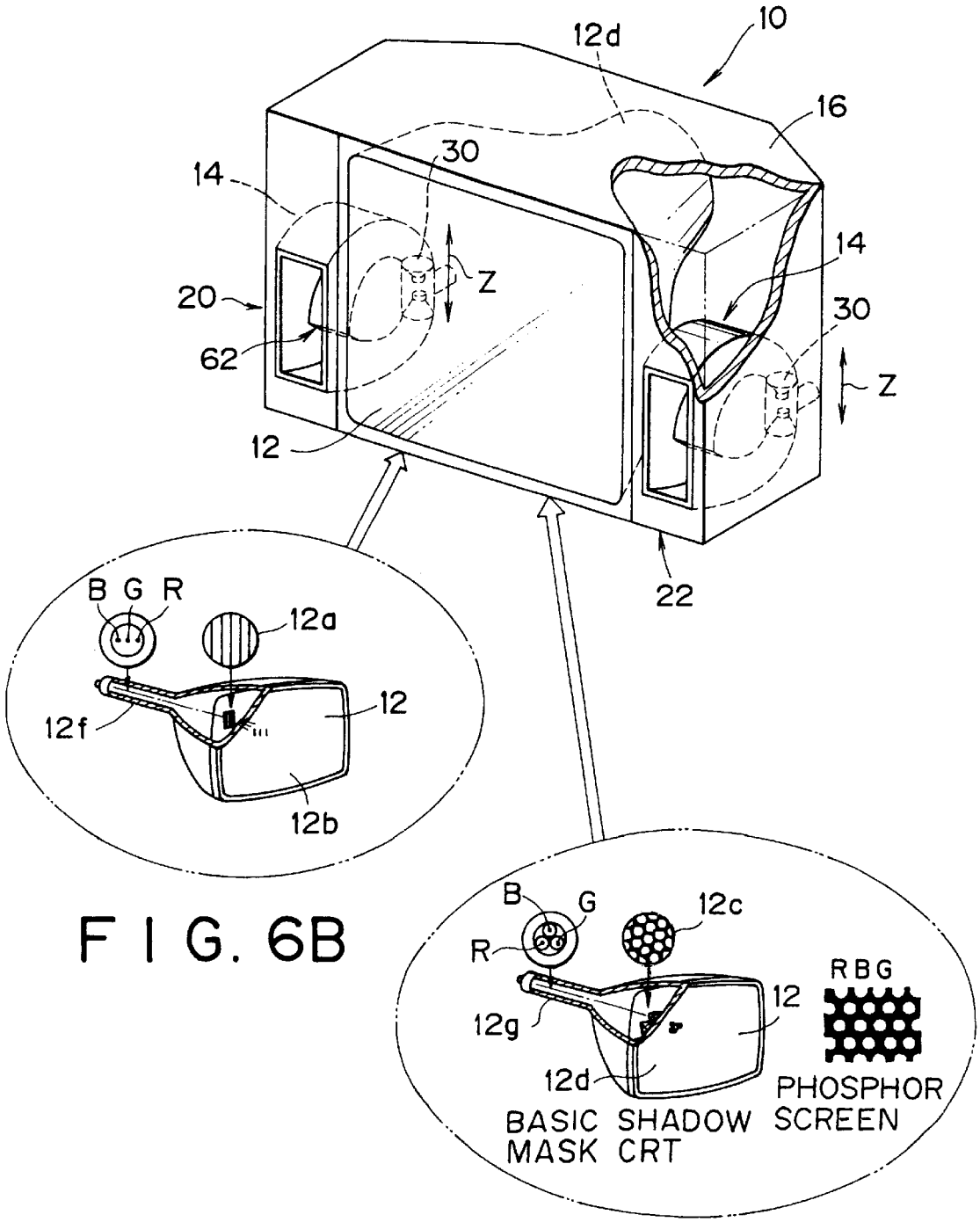
FIG. 6A is a perspective view showing a television set which is one example of electric equipment to which a preferred embodiment of a sound apparatus of the present invention is applied.
FIGS. 6B and 6C are enlarged views each showing the cathode-ray tube of the sound apparatus shown in FIG. 6A.

FIGS. 6A, 6B and 6C show a television set as one example of electric equipment to which one embodiment of a sound apparatus of the present invention is applied. A television set 10 has a cathode-ray tube (CRT) 12 as a display unit and two sound apparatuses 14 for stereophonic reproduction. The cathode-ray tube 12 and two sound apparatuses 14 are provided in a cabinet 16 in such a manner that the two sound apparatuses 14 are positioned on the front surface side of the cabinet 16 and on the right and left sides of the cathode-ray tube 12.

The cathode-ray tube 12 may be of a type shown in FIGS. 6B or 6C. The cathode-ray tube 12 of the type shown in FIG. 6B has a vertical aperture grill 12*a* facing to a phosphor screen 12*b*.

The cathode-ray tube 12 of the type shown in FIG. 6C has a shadow mask 12*c* also facing to a phosphor screen 12*d*. In addition, either the aperture grill 12*a* or the shadow mask 12*c* is selected in accordance with the type of an electron gun 12*f* or 12*g* used in the cathode-ray tube 12.

The two sound apparatuses 14 are respectively disposed in right and left opening portions 20 and 22 of a front surface section of the cabinet 16 of the television set 10 provided with the cathode-ray tube 12.

Figure 7:
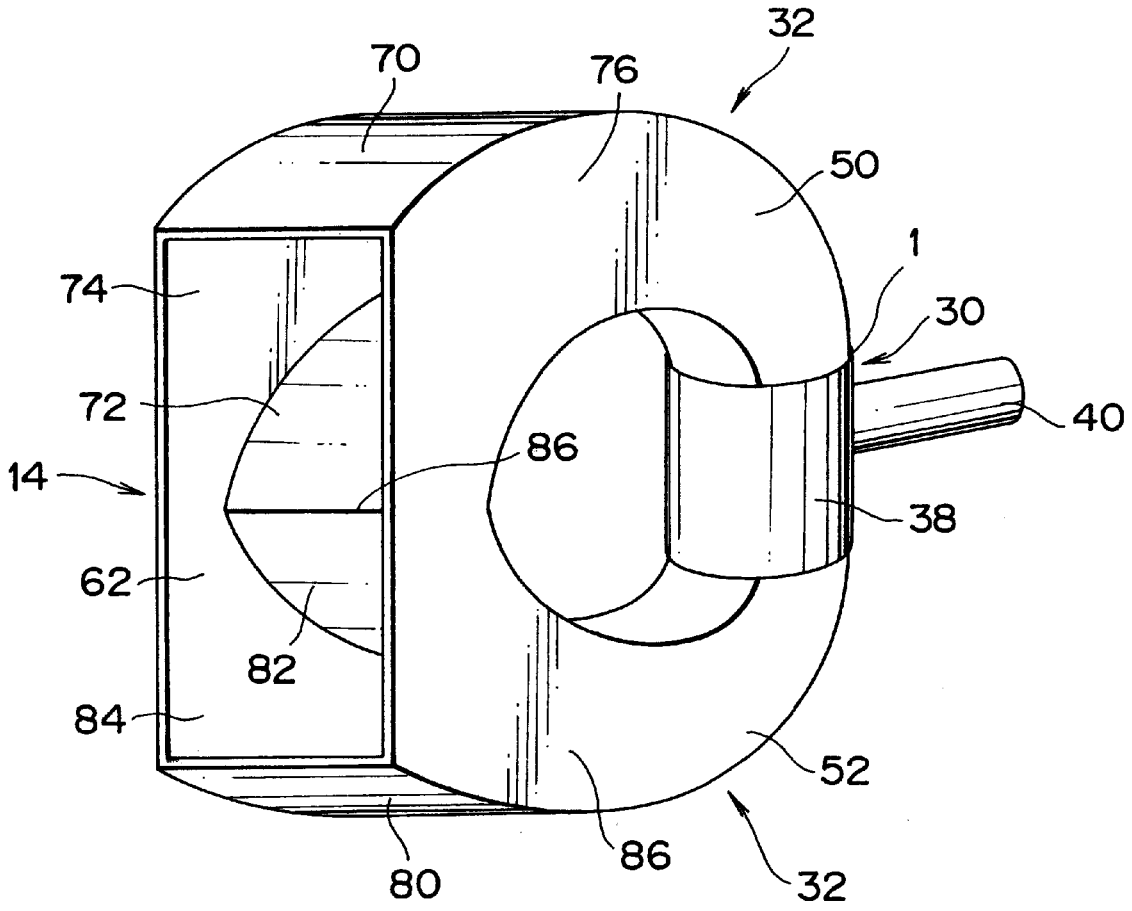
FIG. 7 is a perspective view of the sound apparatus shown in FIG. 6A.
Figure 8:
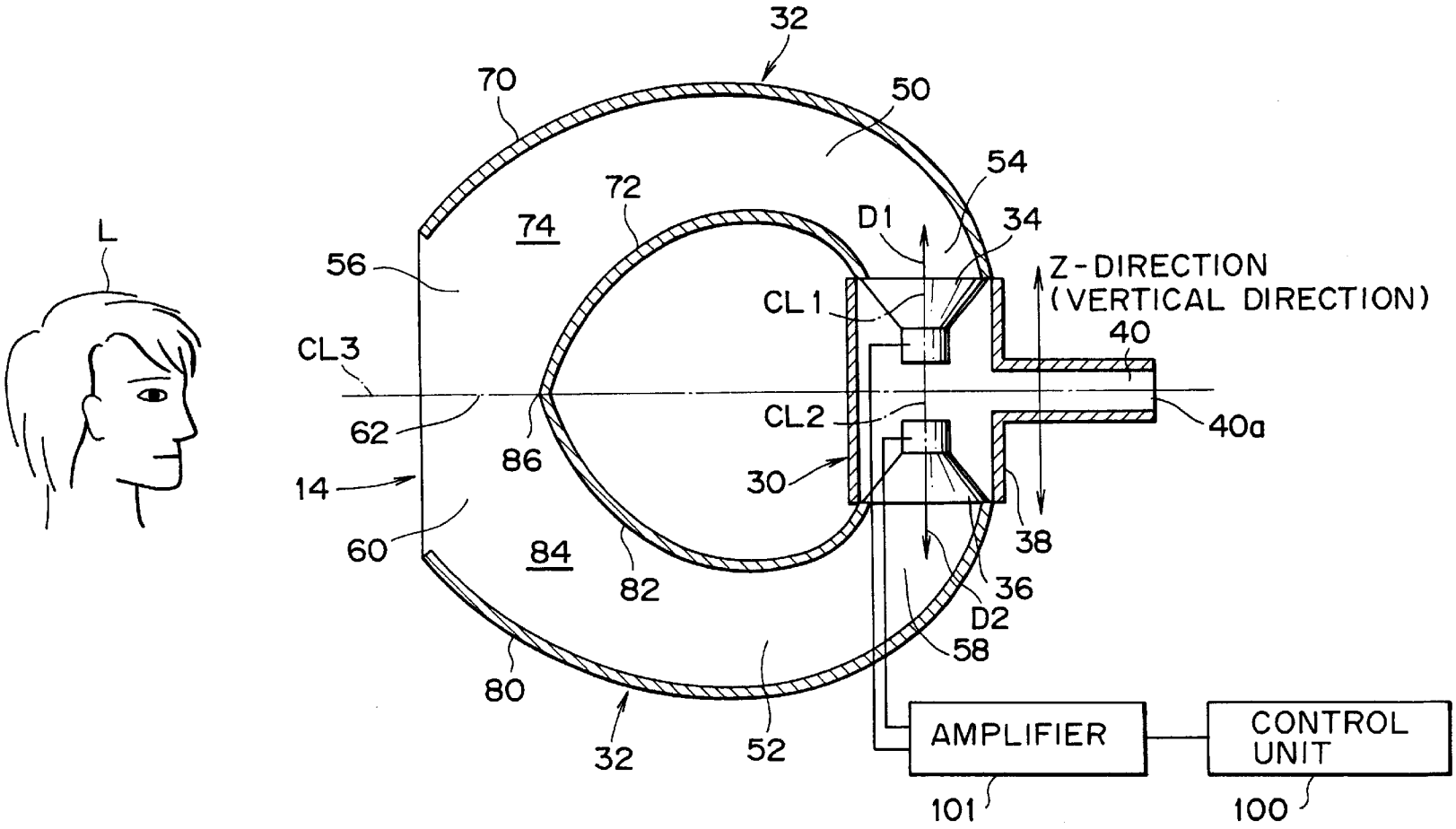
FIG. 8 is a sectional view showing an internal structure of the sound apparatus shown in FIG. 7.

FIGS. 7 and 8 show in detail the structure of the sound apparatus 14 shown in FIG. 6A. Referring to FIGS. 7 and 8, the sound apparatus 14 basically includes a speaker portion 30 and two sound guides 32.

The speaker portion 30 has a first speaker 34, a second speaker 36, a speaker container 38, and an outlet portion 40.

The speaker container 38, typically formed into a cylindrical shape, has in one opening portion first speaker 34 and in the other opening portion second speaker 36. The first and second speakers 34 and 36 are 180° opposite to each other. Specifically, an axis CL1 of the first speaker 34 coincides with an axis CL2 of the second speaker 36; however, a vibration direction D1 of a vibration plate of the first speaker 34 is 180° opposite to a vibration direction D2 of a vibration plate of the second speaker 36.

The above-described outlet portion 40 is connected to an intermediate portion of the speaker container 38, and a free end of the outlet portion 40 is taken as an opening portion 40*a*. The outlet portion 40 is adapted to release pressures generated from the first and second speakers 34 and 36 vibrated in the cylindrical speaker container 38 to the exterior.

The two sound guides 32 will be described in detail below. Referring to FIG. 8, the two sound guides 32 have first and second sound guide portions 50 and 52, respectively. One opening portion 54 of the first sound guide portion 50 is closely connected to the first speaker 34, and similarly one opening portion 58 of the second sound guide portion 52 is closely connected to the second speaker 36. The other opening portion 56 of the first sound guide portion 50 is connected to the other opening portion 60 of the second sound guide portion 52. The opening portion 56 and the opening portion 60 thus connected to each other constitute a sound synthesizing opening portion 62. The sound synthesizing opening portion 62 is typically formed into a rectangular shape as shown in FIGS. 6A to 6C and FIG. 7.

The structure of the sound guides 32 will be more fully described. Referring to FIGS. 7 and 8, the first sound guide portion 50 has an outer wall portion 70, an inner wall portion 72, and side wall portions 74 and 76. The first sound guide portion 50 of one sound guide 32 is symmetric to the second sound guide portion 52 of the other sound guide 32 with respect to a center line CL3. That is, the second sound guide 52 also has an outer wall portion 80, an inner wall portion 82, and side wall portions 84 and 86.

A cross-sectional area of the first sound guide portion 50 becomes gradually larger in the direction from the opening portion 54 to the opening portion 56 of the first sound guide portion 50. Similarly, a cross-sectional area of the second sound guide portion 52 becomes gradually larger in the direction from the opening portion 58 to the opening portion 60 of the second sound guide portion 52. A connection portion 86 at which the inner wall portions 72 and 82 are connected to each other lies on the center line CL3, and is visible from the sound synthesizing opening portion 62.

FIGS. 9 to 14 show a series of trials having been examined to accomplish the sound apparatus 14 shown in FIGS. 6A to 8.

Figure 9:
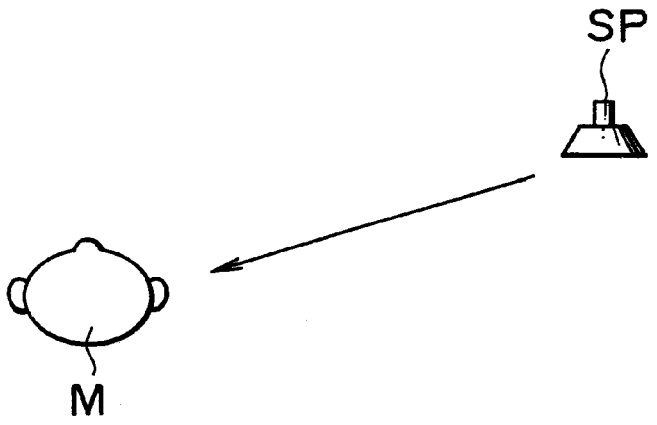
FIG. 9 is a view showing an arrangement of a listener and a right side speaker for description of a configuration principle of the sound apparatus shown in FIGS. 6A to 8.
Figure 10:
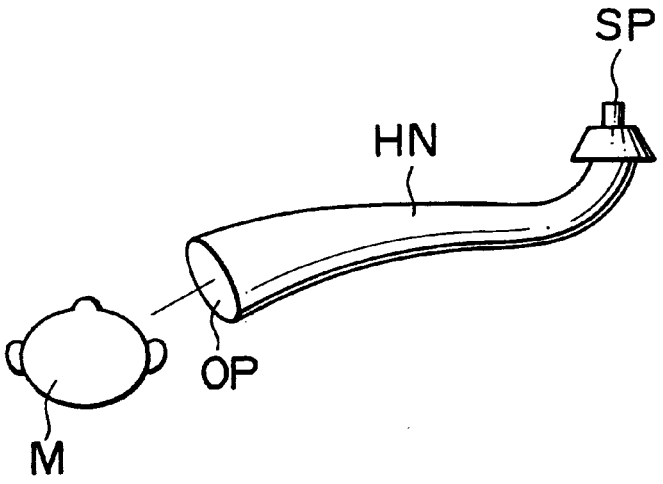
FIG. 10 is a view showing an example in which a horn is provided between the listener and the right side speaker shown in FIG. 9.

FIG. 9 shows a state in which one speaker SP is positioned on the right side of a listener M as a user. In this case, a sound generated from the speaker SP is audible to the listener M from the right side. Now, there will be examined methods of allowing a sound generated from the speaker SP to be audible to the listener M as if the sound was generated at a position being as close to the listener M as possible. For example, in a method shown in FIG. 10, a bell shaped horn HN is connected to the speaker SP and an opening portion OP of the horn HN is positioned near the ears of the listener M. By mounting the horn HN to the speaker SP as described above, a sound generated from the speaker SP is audible to the listener M as if the sound was generated at a position close to the listener M insofar as the horn HN is correctly operated.

Figure 11:
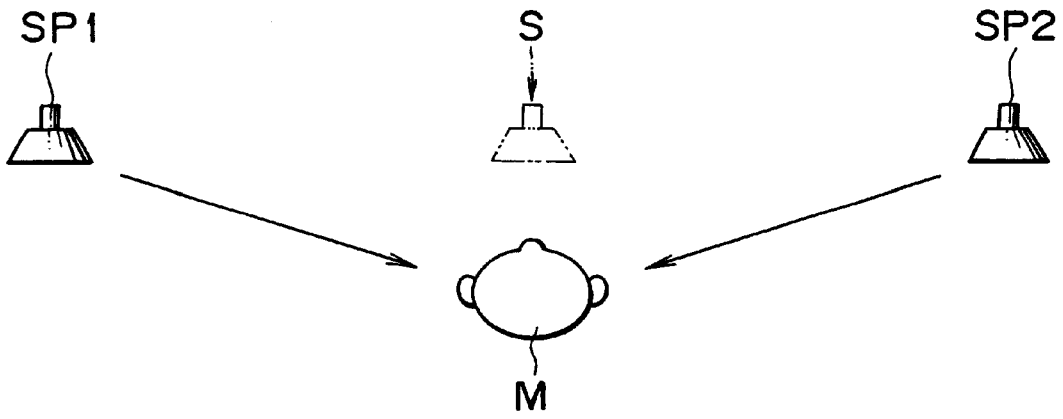
FIG. 11 is a view showing an example in which a virtual sound source is set by arranging a right side speaker and a left side speaker on right and left sides of the listener, in place of the horn shown in FIG. 10.

Another method for allowing a sound generated from the speaker SP to be audible to the listener M as if the sound was generated at a position being as close to the listener M as possible is shown in FIG. 11. Referring to FIG. 11, a left speaker SP1 and a right speaker SP2 are each spaced an equal distance apart from the listener M, to thereby locate a virtual sound source S on the front side of the listener M.

The virtual sound source S is formed in front of the listener M only by inputting the same signal (that is, a monoral sound signal) in the right and left speakers SP2 and SP1. Consequently, it is possible to relatively simply locate the virtual sound source S at a position near the listener M.

Figure 12:
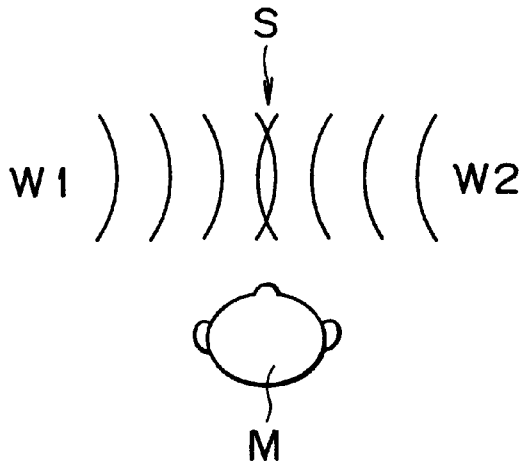
FIG. 12 is a view for physical description of the virtual sound source shown in FIG. 11.

A physical principle of formation of the virtual sound source S shown in FIG. 11 will be described with reference to FIG. 12. Referring to FIG. 12, sounds having the same phase, arising from a sound wave W1 generated from the left speaker SP1 and a sound wave W2 generated from the right speaker SP2, collide with each other at a position of the virtual sound source S. In other words, the sound waves W1 and W2 collide with each other at a front position of the listener M, that is, at a central position of the right and left speakers SP2 and SP1.

Figure 13:
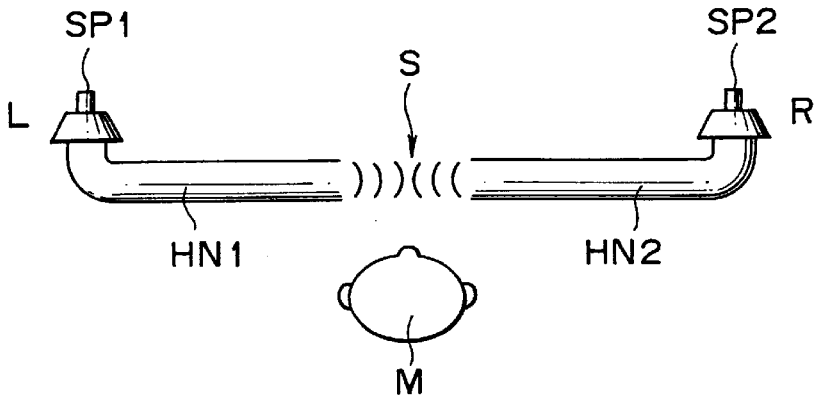
FIG. 13 is a view showing an example in which sound guides are provided between a right speaker and the listener and between a left speaker and the listener.

As shown in FIG. 13, sound guides $HN_1$ and HN2 having the same length are mounted to the left speaker SP1 and the right speaker SP2, respectively. Opening portions of the sound guides HN1 and HN2 are positioned at the front side of the listener M, to thereby form a virtual sound source S at a central position of these opening portions.

Figure 14A:
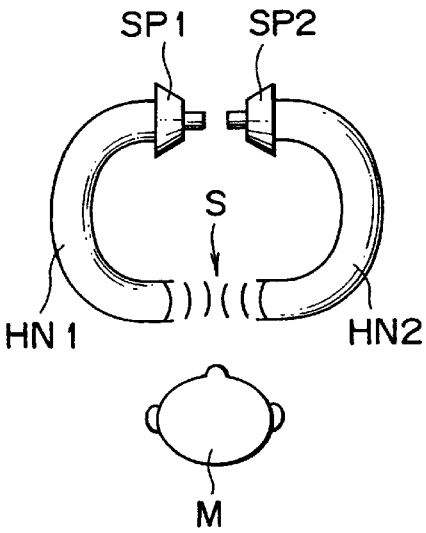
FIG. 14 is a view showing a state in which the sound guides shown in FIG. 13 are curved and the right and left speakers are disposed opposite to each other.

In this way, the virtual sound source S can be formed by arranging the opening portions of the sound guides HN1 and HN2 opposite to each other, and allowing sounds having the same phase generated from the speakers SP1 and SP2 to collide with each other at the central position of these opening portions. As shown in FIG. 14A, the speakers SP1 and SP2 may be disposed opposite, closely to each other and the horns HN1 and HN2 may be curved, to thereby reduce a space in the lateral direction necessary for arrangement of the sound guides HN1 and HN2 . In this case, the lengths of these sound guides HN1 and HN2 are, as described above, set to be nearly equal to each other.

Figure 14B:
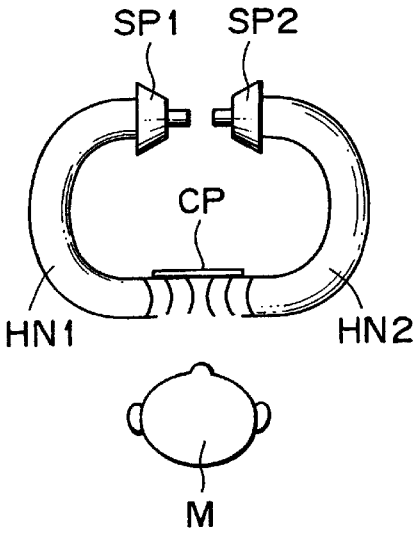

As shown in FIG. 14B, at the opening portions of the sound guides HN1 and HN2, the back side remote from the listener M may be of course blocked with a closing plate CP so that a sound synthesized at the virtual sound source S may be audible only to the listener M.

The structure of the sound apparatus shown in FIG. 14B is basically equivalent to the above-described structure shown in FIGS. 7 and 8.

Referring again to FIGS. 7 and 8, the speaker container 38 functions not only to fix the first and second speakers 34 and 36 but also to prevent sounds having the same phase generated from the first and second speakers 34 and 36 from being leaked to the exterior. However, since a pressure in the speaker container 38 is varied when the vibration plates of the first and second speakers 34 and 36 are vibrated, the speaker container 38 has the outlet portion 40 for releasing the pressing force applied to the speaker container 38 to the exterior therethrough.

The operation of the sound apparatus 14 shown in FIGS. 6A to 8 will be described.

Referring to FIG. 8, when receiving a control signal from a control unit 100, an amplifier 101 supplies a current to voice coils or the like of the first and second speakers 34 and 36.

The vibration plate, typically formed into a conical shape, of the first speaker 34 is thus vibrated in the vibration direction D1, and the conical vibration plate of the second speaker 36 is vibrated in the vibration direction D2. The sounds having the same phase are supplied from the first and second speakers 34 and 36 into the sound guide portions 50 and 52, respectively.

In this way, when signals having the same phase are supplied to the first and second speakers 34 and 36 in a mongural reproducing manner, sounds having the same phase are fed from the first and second speakers 34 and 36 through the sound guide portions 50 and 52 into the opening portions 56 and 60, respectively. Then, the sounds having the same phase collide with each other at the synthesizing opening portion 62, to be thus synthesized. The sound synthesized at the virtual sound source S is substantially oriented along the center line CL3.

This is because the path lengths of the first and second sound guide portions 50 and 52 are nearly equal or perfectly equal to each other; the sectional opening areas thereof are equal to each other; and the shapes thereof are equal to each other. In this way, by guiding the sounds having the same phase into each of the left portion 20 and the right portion 22 of the cabinet 16 shown in FIGS. 6A to 6C through the first and second sound guide portions 50 and 52 and synthesizing the sounds by collision, the sound thus synthesized is audible to the listener M as if the sound was generated from one speaker positioned on the center line CL3, that is, at the synthesizing opening portion 62. As a result, in FIGS. 6A to 6C, even if each speaker portion 30 is positioned near the electron gun of the cathode-ray tube 12, a sound generated from the speaker portion 30 is audible to the listener M as if the sound is generated from a speaker located at the position of the synthesizing opening portion 62.

In the television set 10 shown in FIGS. 6A to 6C, one sound apparatus 14 is disposed at the left portion 20 of the cabinet 16 and another sound apparatus 14 is disposed at the right portion 22 of the cabinet 16. A signal for a left side channel is supplied to the two speakers of the speaker portion 30 of the sound apparatus 14 disposed at the left portion 20 and a signal for a right side channel is supplied to the two speakers of the speaker portion 30 of the sound apparatus 14 disposed at the right portion 22.

With this configuration, the television set 10 shown in FIGS. 6A to 6C allows the listener M to enjoy stereo broadcasting through the two sound apparatuses 14 on the right and left portions 22 and 20 while taking a look at an image on the cathode-ray tube 12.

Since the vibration direction D1 along which the first speaker 34 is vibrated is opposite to the vibration direction D2 along which the second speaker 36 is vibrated as shown in FIG. 8, reactions of the first and second speakers 34 and 36 are canceled each other.

Since the vibration directions D1 and D2 along which the first and second speakers 34 and 36 are respectively vibrated are along the Z-direction (vertical direction) in FIGS. 6A to 6C and FIG. 8, they do not exert any effect on color separation because a color signal is supplied to the aperture grill 12*a* or shadow mask 12*c* (particularly, the recent inline electron gun type) shown in FIGS. 6A to 6C in the direction of color separation (lateral direction of the cathode-ray tube 12) perpendicular to the Z-direction.

Figure 15:
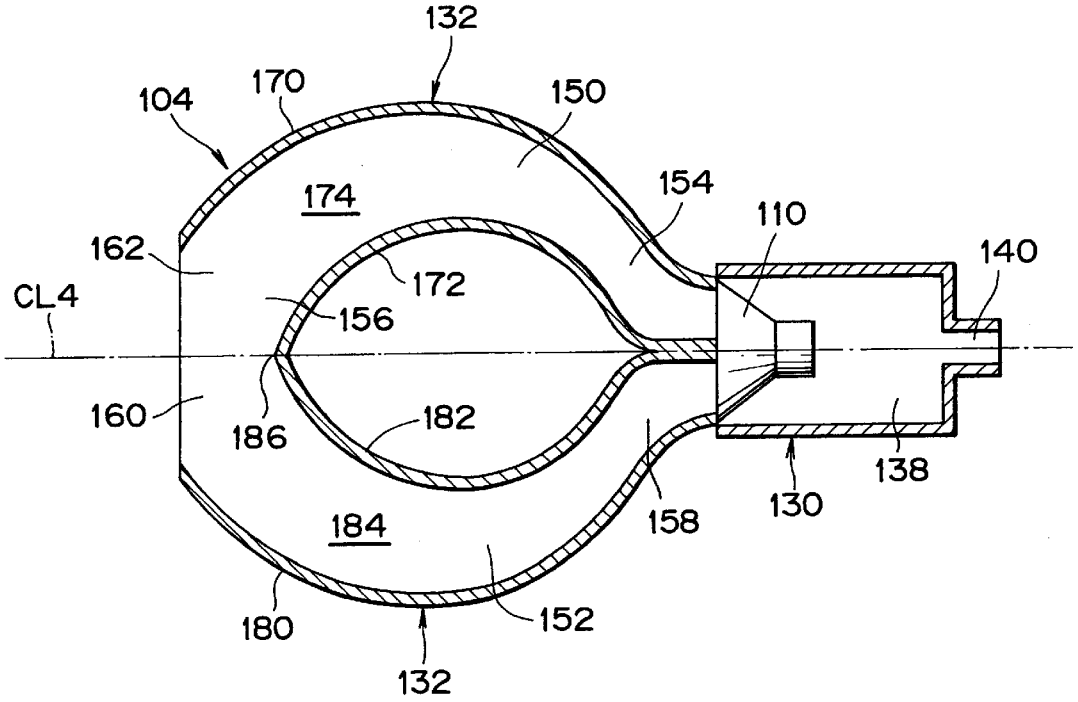
FIG. 15 is a view showing another embodiment of the sound apparatus of the present invention.

FIG. 15 shows another embodiment of the sound apparatus of the present invention. A sound apparatus 104 shown in FIG. 15 includes a speaker portion 130 which has one speaker 110. The speaker 110 is fixed to an opening portion at one end of a speaker container 138 of the speaker portion 130, and an outlet portion 140 is provided at the other end of the speaker container 138. The outlet portion 140 is adapted to release a sound pressure generated in the speaker container 138 when the speaker 110 is vibrated.

Two sound guides 132 are provided to the speaker 110 of the speaker portion 130. The sound guides 132, each of which has the same configuration as that of the sound guide 32 shown in FIGS. 7 to 8, are closely connected to one speaker 110. These sound guides 132 have first and second sound guide portions 150 and 152, respectively. The first sound guide portion 150 of one sound guide 132 has an outer wall portion 170, an inner wall portion 172, and two side wall portions 174.

Similarly, the second sound guide portion 152 of the other sound guide 132 has an outer wall portion 180, an inner wall portion 182, and two side wall portions 184.

The first and second sound guide portions 150 and 152, each of which has a rectangular cross-section, are symmetric to each other with respect to a center line CL4. The cross-sectional area of the first sound guide portion 150 becomes gradually larger in the direction from an opening portion 154 to an opening portion 156 of the first sound guide portion 150, and similarly the cross-sectional area of the second sound guide portion 152 becomes gradually larger in the direction from an opening portion 158 to an opening portion 160 of the second sound guide portion 152. A synthesizing opening portion 162 is formed at a connection portion 186 at which the opening portions 156 and 160 are connected to each other.

A sound generated from the speaker 110 is divided into two semi-circular parts which are respectively transmitted in the first and second sound guide portions 150 and 152. The two semi-circular parts of the sound collide with each other in the synthesizing opening portion 162, to be thus synthesized.

Even in the case of using one speaker, since the semi-circular parts of the sound generated from the speaker 110 are nearly equal to each other, they can be synthesized in the synthesizing opening portion 162 like the case where two speakers are arranged in the speaker portion 130.

A further embodiment of the sound apparatus of the present invention will be described below with reference to FIG. 16.

Figure 16:
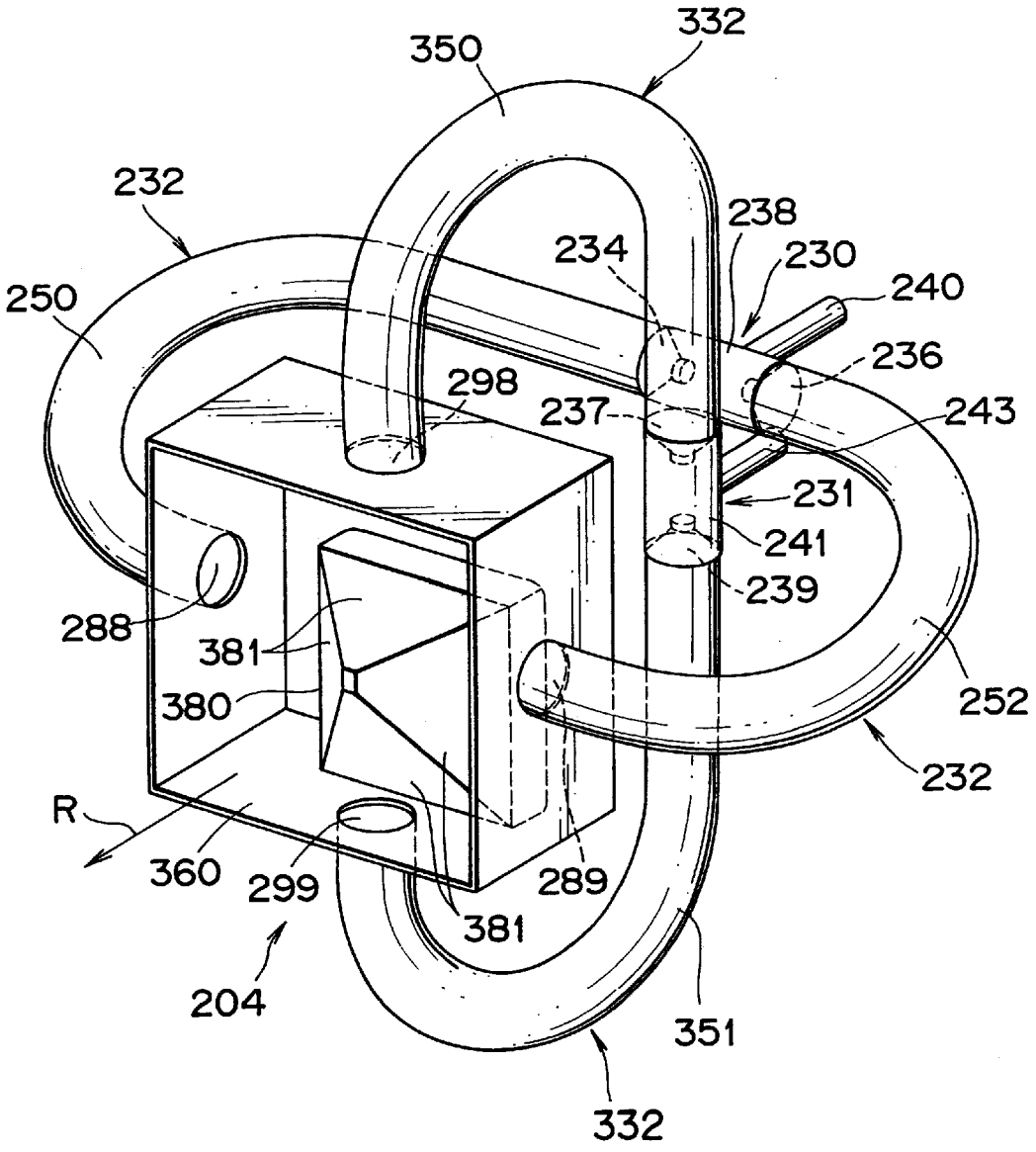
FIG. 16 is a view showing a further embodiment of the sound apparatus of the present invention.

A sound apparatus 204 shown in FIG. 16 has speaker portions 230 and 231. The speaker portion 230 has two speakers 234 and 236 and the speaker portion 231 has two speakers 237 and 239.

A speaker container 238 of the speaker portion 230 fixes the speakers 234 and 236, and the other speaker container 241 fixes the speakers 237 and 239. In the speaker container 238, the speakers 234 and 236 are 180° opposite to each other. Similarly, in the speaker container 241, the speakers 237 and 239 are 180° opposite to each other.

Two sound guides 232 have first and second sound guide portions 250 and 252 respectively, and two sound guides 332 have first and second sound guide portions 350 and 351 respectively. The lengths of the first and second sound guide portions 250 and 252 are nearly equal to each other, and the lengths of the first and second sound guide portions 350 and 351 are nearly equal to each other. The speaker container 238 has an outlet portion 240, and the speaker container 241 has an outlet portion 243.

Opening portions 288 and 289 of the first and second sound guide portions 250 and 252 are connected (opened) to opposite positions of a sound synthesizing box 360, and opening portions 298 and 299 of the first and second sound guide portions 350 and 351 are connected (opened) to opposite positions of the sound synthesizing box 360. Accordingly, these opening portions 288, 289, 298 and 299 are spaced at equal phases of 90°.

A guide portion 380 is provided at a central position of the opening portions 288, 289, 298 and 299, and sound waves outgoing from the four opening portions 288, 289, 298 and 299 are synthesized (by collision) through four slopes 381, to be fed in the forward direction indicated by an arrow R. In addition, sounds having the same phase are generated from the four speakers 234, 236, 237 and 239 for monoral reproduction.

As described above, according to the embodiments of the present invention, there is provided a sound apparatus using a plurality of sound guides (often called horns) whose lengths are nearly equal or perfectly equal to each other, wherein sounds generated from one or a plurality of speakers are oppositely transmitted through the sound guides and synthesized by collision in a synthesizing opening portion, to obtain an audio image as if the audio image was generated from one speaker disposed in the synthesizing opening portion, thereby preventing obscure feeling and confined feeling of sound from being given to a listener.

While the preferred embodiments of the present invention have been described using specific terms, such description is for illustrative purposes only, and it is to be understood that changes and variations may be made without departing from the spirit or scope of the present invention.

For example, in the embodiments of the present invention, as shown in FIGS. 6A to 6C, the two sound apparatuses 14 are provided for enjoying stereo broadcasting; however, the present invention is not limited thereto. That is, the sound apparatus of the present invention can be applied not only to a television set but also to an audio set as the electric equipment, and further to electric equipment of a different type and in a different field, for example, a computer.

The cross-sectional shape of a sound guide often called a horn is not limited to a rectangular shape but may be of course a circular or elliptic shape. Further, a so-called horn type sound guide may be used in which an opening area of the sound guide on the speaker side is smaller than an opening area of the sound guide on the terminal side, more specifically, the opening area of the sound guide becomes gradually larger in the direction from the speaker side to the terminal side.

An equal cross-sectional type sound guide may be of course adopted in which a cross-section of an opening portion on the speaker side is equal to that of an opening portion on the terminal side. Also, the number of speakers is not limited to one, two or four pieces but may be of course three or five or more pieces.

What is claimed is:

1. A sound apparatus comprising:

a speaker portion including two speakers arranged to face away from each other in opposite directions, whereby phases of sound waves respectively generated by said two speakers are identical to each other;

two sound guides having semi-circular lengths and wherein each of said two sound guides has a first end portion and a second end portion, each said first end portion being closely connected respectively to one of said two speakers, and each said second end portion being opened, wherein said semi-circular lengths of said two sound guides are substantially equal to each other; and a sound synthesizing opening portion formed by connecting together said opened second end portions of said two sound guides, whereby said sound waves generated from said two speakers are guided respectively through said two sound guides and collide with each other in said sound synthesizing opening portion to form a synthesized sound.

2. The sound apparatus according to claim 1, wherein cross-sections of said two sound guides are equal to each other at every position measured in a direction perpendicular to said cross-sections.

3. The sound apparatus according to claim 1, wherein a cross-section of each of said two sound guides becomes gradually larger in a direction from said first end portion to said second end portion thereof.

4. A sound apparatus comprising:

a speaker portion including two speakers arranged to face in opposite directions, whereby phases of sound waves respectively generated by said two speakers are substantially identical;

two sound guides each of which has a first end portion and a second end portion, each of said first end portions being connected respectively to one of said two speakers, and each of said second end portions being opened, wherein lengths of said two sound guides are substantially equal, wherein said second end portions of said two sound guides are arranged such that the sound waves generated from said two speakers are guided through said two sound guides and collide with each other to form a synthesized sound, wherein said sound apparatus is disposed near a color cathode-ray tube having one of an aperture grill and a shadow mask, and each of said two speakers comprises a vibration plate that is vibrated in a vertical direction relative to a horizontal scanning direction of the color cathode ray tube.

* * * * *